United States Patent [19]

Agata

[11] Patent Number: 4,682,903

[45] Date of Patent: Jul. 28, 1987

[54] THIN LINE PRINTER TYPING HEAD

[75] Inventor: Kazuhiro Agata, Osaka, Japan

[73] Assignee: NEC Home Electronics Ltd., Osaka, Japan

[21] Appl. No.: 718,387

[22] Filed: Apr. 1, 1985

[30] Foreign Application Priority Data

Mar. 30, 1984 [JP] Japan ..... 59-62840
May 31, 1984 [JP] Japan ..... 59-111623

[51] Int. Cl.[4] ..... B91J 3/10
[52] U.S. Cl. ..... 400/121; 101/93.04
[58] Field of Search ..... 400/121; 101/93.04, 101/93.33, 93.34

[56] References Cited

U.S. PATENT DOCUMENTS 4,351,235 9/1982 Bringhurst ..... 400/121
4,428,284 1/1984 Thorne ..... 400/121
4,484,519 11/1984 Kurihara et al. ..... 400/121
4,527,469 7/1985 Wolf et al. ..... 400/121
4,546,699 10/1985 Thorne et al. ..... 101/93.04

FOREIGN PATENT DOCUMENTS 106874 8/1981 Japan ..... 400/121
2023353 12/1979 United Kingdom ..... 400/121

OTHER PUBLICATIONS

Hanna et al, "Dot Band Print Element", IBM Technical Disclosure Bulletin vol. 24, No. 10, p. 5070, 3/82.

*Primary Examiner*—William Pieprz
*Attorney, Agent, or Firm*—Cushman, Darby & Cushman

[57] ABSTRACT

A thin line printer head in which the leaf springs each extend horizontally in a line between a fixed and free end. The leaf springs may be formed in a flat spring plate by removing portions and adjacent springs may extend oppositely from a central portion of the plate.

7 Claims, 6 Drawing Figures

THIN LINE PRINTER TYPING HEAD

BACKGROUND AND SUMMARY OF THE INVENTION

This invention relates to a typing head for a line printer.

A conventional typing head for a line printer is shown in FIG. 1. In FIG. 1, numerals 1, 2, 3 and 4 designate leaf springs, permanent magnet, yoke, and demagnetizing coils, respectively. Yoke 3, magnet 2 and coils 4 form a yoke assembly. Leaf springs 1 have fixed ends 1*b* thereof secured by screws 7 between a clamp plate 6 and a fixture 5 rigidly mounted on yoke 3. Leaf springs 1 also have free ends thereof attracted and flexed by permanent magnet 2. Coils 4 are actuated to cause hammer pins 8 disposed on the free ends of the leaf springs 1 to strike against a suitable paper or the like.

One disadvantage of this prior art, however, is that the typing head must be dimensioned as least as high as the length of the leaf springs 1. This is too high to fabricate a thin type of head. Further, the leaf springs 1 which include the fixed ends 1*b* are vertically disposed in parallel with each other. Accordingly, the free ends 1*a* are susceptible to deformation in the typing plane resulting in deterioration in typing quality.

It is an object of the invention to provide a thin head producing high typing quality and not readily deformed by external forces.

For accomplishing this object, the leaf springs are arranged side by side in a line. More specifically, each of the leaf springs extends horizontally with its free and fixed ends in a line to establish the relation of the yoke to the adjacent leaf springs with a fixture disposed therebetween.

According to the invention, the leaf springs are horizontally formed in a line and made thinner. Further, the leaf springs are preferably made by punching a flat spring. The free ends of each leaf spring are surrounded by spring surfaces, thereby being resistant to deformation by external force. Pairs of springs may be formed to extend in opposite horizontal directions from a central portion to reduce the number of fasteners required.

DETAILED DESCRIPTION OF THE DRAWINGS

Figure 1:
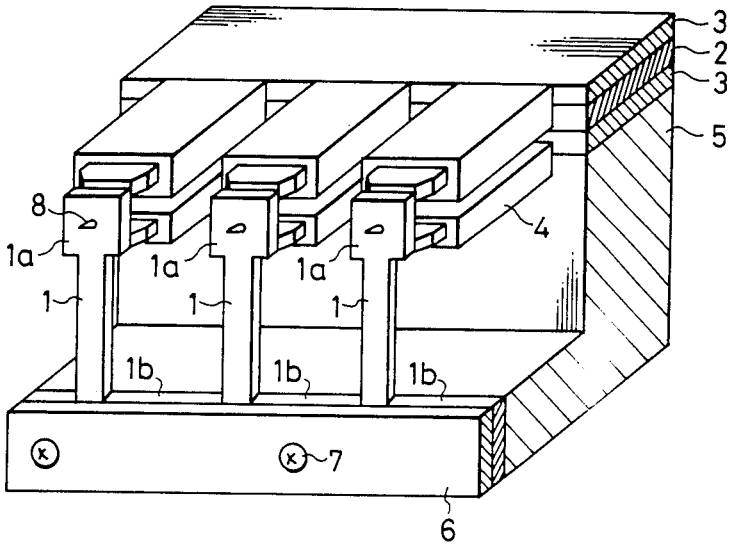
FIG. 1 PRIOR ART
FIG. 1 is a perspective view of a conventional prior art apparatus.
Figure 2:
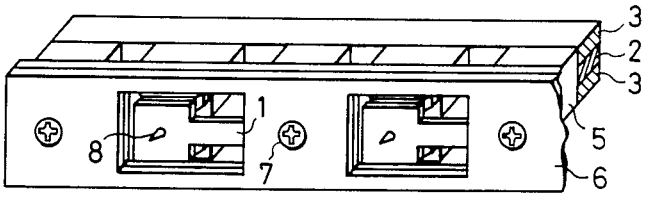
FIG. 2 is a perspective view of an apparatus embodying the present invention.
Figure 3:
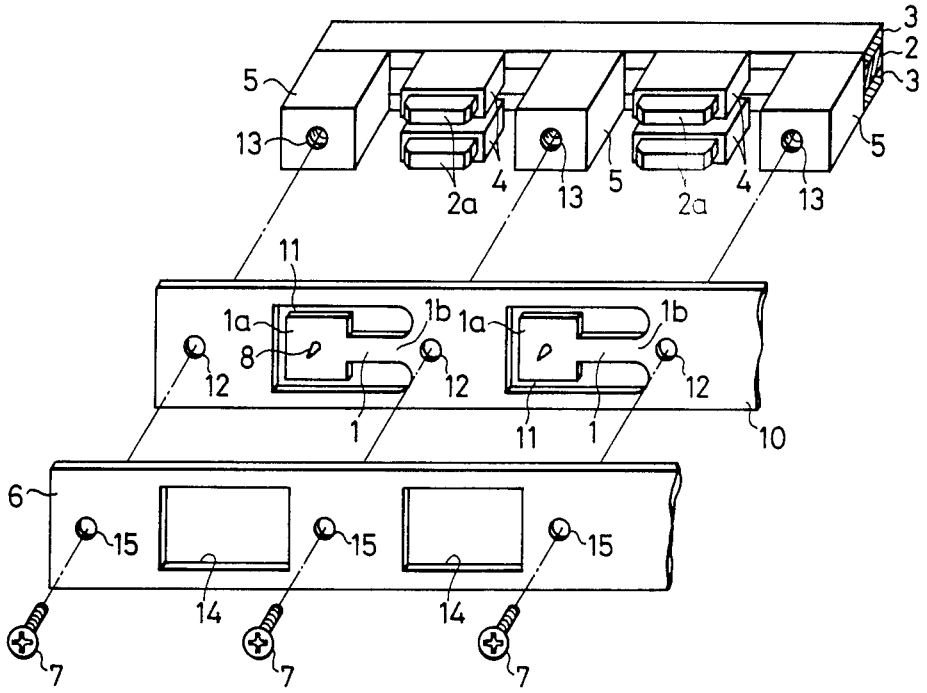
FIG. 3 is a perspective view showing the steps of assembling the instant apparatus shown in FIG. 2.

FIGS. 2 and 3 show a first embodiment of the present invention. Like numerals are used to designate like parts as in FIG. 1. In contrast to FIG. 1 a plurality of the leaf springs 1 are each formed in a flat spring 10 and horizontally arranged side by side in a line. Each of the springs 1 are arranged with the free and fixed ends 1*a* and 1*b* in a line in the horizontal direction. Leaf springs 1 are each formed by punching the flat spring 10 to leave the fixed ends 1*b*, while providing surfaces 11 which surround free ends 1*a*. Thus the fixed ends 1*b* of all springs 1 are integral. Mounting holes 12 are bored through the flat spring 10 for mounting flat spring 10 to fixtures 5. Each of the free ends 1*a* includes a hammer pin 8 in the same manner as in the prior art.

Yoke 3 includes portions 2*a* extending therefrom to correspond to the free ends 1*a* of the leaf springs 1 and fixtures 5 alternate with portions 2*a*. Fixtures 5 are formed with mounting holes 13, and yoke 3 carries permanent magnet 2 and demagnetizing coils 4. A clamp plate 6 includes openings 14 through which the free ends 1*a* pass, and mounting holes 15 correspond to the mounting holes 12 and 13 of flat spring 10 and fixtures 5 respectively. Screws 7 assemble plate 6, spring 10, yoke 3 and the elements fixed to yoke 10 into a printer assembly.

The typing head according to the present invention is designed so that a plurality of the leaf springs 1 are crosswise placed in a line to reduce the vertical dimension (height), permitting a thin head. The leaf springs 1 when formed by punching flat spring 10 are arranged longitudinally thereof. Surfaces 11 are thus provided peripherally of the leaf springs 1 except for the fixed ends 1*b* thereof to leave a portion of the flat spring 10 peripherally and in close proximity to the leaf springs, thereby minimizing the cutout area. Especially, a portion of the flat spring 10 peripherally of the leaf springs 1 serves as a protection of the leaf springs to minimize possible deformation derived from external force, thereby preventing typing quality from deteriorating.

It is understood that the invention is not limited to the embodiment aforementioned, and, for example, may be applicable to an arrangement in which the fixtures 5 are integrally formed with the upper or lower yoke 3.

Figure 4:
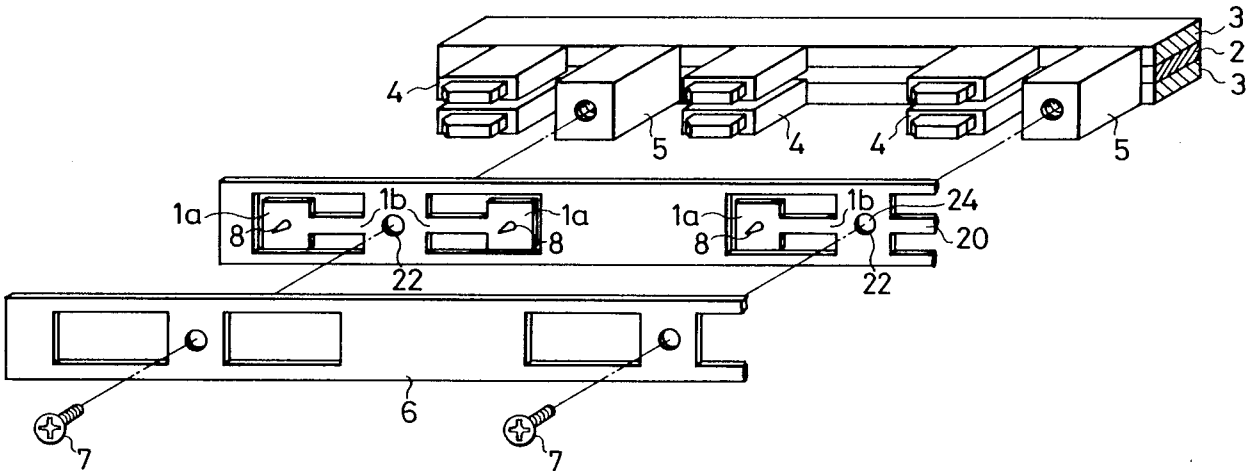
FIG. 4 is an exploded view of a second embodiment of the present invention.
Figure 5:
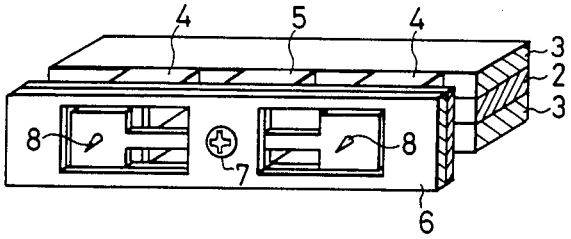
FIG. 5 is a perspective view of the assembled unit of FIG. 4.

Reference is now made to FIGS. 4 and 5 which illustrate a second embodiment of the invention. As above, like numerals are used to designate like parts as in FIG. 1. Spring plate 20 is punched to define a plurality of horizontally extending leaf springs 1. However, pairs of springs extend in opposite horizontal directions from a central portion 22 defining the fixed ends 1*b* of the pair of springs. Bore 24 is drilled through central portions 22 for receiving screws 7 which fix clamp plate 6 and spring plate 20 to fixtures 5. Only one screw need be provided for each pair of springs, simplifying assembly. Plate 6 is provided with openings adjacent each spring 1 as in the first embodiment.

Figure 6:
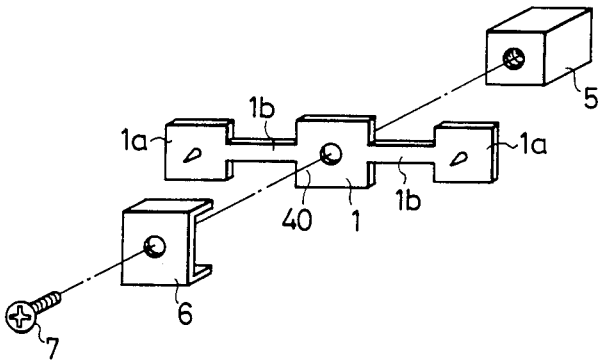
FIG. 6 is an exploded cut-away view of a portion of a third embodiment of the present invention.

FIG. 6 shows a portion of a third embodiment of the invention in which each pair of springs 1 extend in opposite horizontal directions from a common central portion 40. As above, like numerals are used to designate like parts as in FIG. 1. Free ends 1*b* of each pair of springs are exposed and free of any adjacent surfaces or openings. Clamp plate 6 is provided with bent upper and lower edges to fix springs 1 to fixture 5. Other pairs of springs (not shown) are provided in a horizontal line as in FIGS. 4 and 5. The yoke assembly is as described above and shown in FIGS. 4 and 5. Forming the springs as in FIG. 6 economizes material.

Many changes and modifications in the above described embodiment of the invention can of course be carried out without departing from the scope of the invention which is therefore intended to be limited only by the scope of the appended claims.

What is claimed is:

1. A thin line printer typing head comprising:

a yoke assembly including a yoke, a magnet mounted on said yoke and a plurality of coils mounted on said yoke;

means defining a plurality of horizontally extending leaf springs, each spring extending from a fixed end to a free end mounting a hammer pin and displaceable by actuation of an associated coil, said defining means having a flat spring plate with portions removed to define said springs with aid fixed and free ends of said springs together extending in a horizontal line, said spring plate surrounding said spring free ends;

means for mounting said yoke assembly to said leaf springs defining means; and a horizontally extending clamp plate for clamping said leaf spring and said yoke assembly together, said clamp plate having apertures surrounding said leaf springs.

2. A head as in claim 1 wherein said mounting means includes a plurality of fixtures extending from said yoke alternately with said coils, a clamp plate having a plurality of openings each corresponding to one of said leaf springs and means for fixing said clamp plate and spring plate to said fixtures with said spring plate between said clamp plate and said fixtures.

3. A head as in claim 1 wherein alternate leaf springs extend in opposite horizontal directions.

4. A head as in claim 3 wherein said defining means includes a spring plate having a central portion defining the fixed end of a pair of adjacent leaf springs extending in opposite horizontal directions therefrom to respective free ends.

5. A head as in claim 4 wherein said mounting means includes a fixture extending outwardly from said yoke between adjacent coils, a clamp plate having at least first and second openings corresponding respectively to said free ends of said pair of adjacent leaf springs and mounting means extending through a bore in said spring plate for fixing said clamp plate and spring plate to said fixture with said spring plate between said clamp plate and said fixture.

6. A head as in claim 5 wherein said fixing means is a screw.

7. A head as in claim 3 wherein said defining means includes a flat spring plate with portions removed to define pairs of adjacent leaf springs, each pair of springs extending from a central portion defining fixed ends of said pair of springs in opposite horizontal directions to a free end, said fixed and free ends of said springs extending in a horizontal line.

* * * * *